US005542874A

United States Patent [19]

Chikaki

[11] Patent Number: 5,542,874

[45] Date of Patent: Aug. 6, 1996

[54] WAFER POLISHING APPARATUS

[75] Inventor: Shinichi Chikaki, Tokyo, Japan

[73] Assignee: NEC Corporation, Tokyo, Japan

[21] Appl. No.: 306,974

[22] Filed: Sep. 16, 1994

[30] Foreign Application Priority Data

Sep. 20, 1993 [JP] Japan ..... 5-232890

[51] Int. Cl.[6] ..... B24B 7/00

[52] U.S. Cl. ..... 451/158; 451/160; 451/289

[58] Field of Search ..... 451/41, 63, 158, 451/159, 160, 287, 288, 289, 290, 291

[56] References Cited

U.S. PATENT DOCUMENTS

| | | | |
|---|---|---|---|
| 4,128,968 | 12/1978 | Jones | 451/158 |
| 4,232,485 | 11/1980 | Eadon-Allen | 451/159 |
| 4,693,036 | 9/1987 | Mori | 451/289 |
| 4,956,944 | 9/1990 | Ando et al. | 451/159 |

OTHER PUBLICATIONS

"Nitride–Masked Polishing (NMP) Technique for Surface Planarization of Interlayer–Dielectric Films", by Y. Hayashi et al., Japan Appln. Physics, vol. 32, No. 3A, Mar. 1993, pp. 1060–1063.

*Primary Examiner*—M. Rachuba

*Attorney, Agent, or Firm*—Sughrue, Mion, Zinn, Macpeak & Seas

[57] ABSTRACT

A wafer polishing apparatus has a wafer chuck for holding a wafer with a surface to be polished directed upward, the wafer chuck being rotatable by a wafer chuck rotation motor; a pair of nozzles for supplying slurries used as polishing solutions to the wafer; and a polishing head for holding a polishing cloth pad which is smaller in diameter than the wafer. The polishing head is rotated in the same direction as the wafer chuck by a polishing head rotation motor and is also reciprocally moved along the surface of the wafer to be polished by an arm driving motor. The wafer polishing apparatus also has a polishing head load adjusting air cylinder for pressing the polishing cloth pad against the wafer by way of the polishing head.

4 Claims, 5 Drawing Sheets

WAFER POLISHING APPARATUS

BACKGROUND OF THE INVENTION

1. Field of the Invention

The present invention relates to a polishing apparatus, and more particularly to a wafer polishing apparatus for polishing a wafer in the process of fabricating a semiconductor integrated circuit.

2. Description of the Prior Art

FIG. 1 of the accompanying drawings shows a conventional wafer polishing apparatus.

As shown in FIG. 1, the wafer polishing apparatus primarily includes a wafer chuck 62 for holding a wafer 61 with the surface to be polished being directed downward, the wafer chuck 62 being rotatable in the direction indicated by arrow B by a first drive means (not shown) and reciprocally movable in the directions indicated by arrows C by a reciprocating means (not shown), a surface plate 67 with a polishing cloth pad 64 attached thereto larger in diameter than the wafer 61, the surface plate 67 being rotatable in the direction indicated by arrow A, which is the same direction as direction B, by a second drive means (not shown), a pair of nozzles 65 for supplying a slurry 66 used as a polishing solution to the polishing cloth pad 64, and a pressing means (not shown) for pressing, by way of the wafer chuck 62, the wafer 61 against the polishing cloth pad 64.

The wafer 61 may be held by the wafer chuck 62 by either suction by a vacuum or adherence by wax, a solution, or water. A flange may be used to secure the outer circumferential edge of the wafer 61 in order to prevent displacement of the wafer 61. The polishing cloth pad 64 has a radius which is about twice the diameter of the wafer 61. The size of the surface plate 67 is about five times the size of the wafer 61. The slurry 66 comprises a suspension composed of a mixture of an aqueous solution of KOH and a fine powder of silicon oxide.

To polish the wafer 61, the wafer 61 is fixed to the wafer chuck 62 with the surface to be polished being directed downward, and the wafer 61 is pressed against the surface plate 67 by way of wafer chuck 62. With the slurry 66 supplied from the nozzles 65 to the polishing cloth pad 64, the wafer chuck 62 is rotated in direction B and the surface plate 67 is rotated in directions A, i.e., in the same direction, while at the same time the wafer chuck 62 is reciprocally moved, thereby polishing the wafer 61. At this time, the wafer 61 is pressed against the polishing cloth pad 64 by the pressing means under a pressure of about 500 g/cm$^2$ through the wafer chuck 62. The slurry 66 is supplied at a rate of about 50 ml/min., the surface plate 67 is rotated at a speed of about 40 rpm, the wafer chuck 62 is rotated at a speed of about 40 rpm, and the wafer chuck 62 makes 10–20 reciprocating movements per minute. In this manner, a plasma CVD silicon oxide film on the surface of the wafer 61 is polished at a rate of about 100 nm/min. The length of the stroke of reciprocal movement of the wafer chuck 62 is about the same as the radius of the wafer 61. Some wafer polishing apparatus have a plurality of wafer chucks to increase the number of wafers that can be polished per unit time.

According to recent processes used in fabricating semiconductor integrated circuits, wafers are polished to a mirror finish, and attempts are also made to flatten surface irregularities of interlayer insulating films and conductive films during the formation of devices on wafer surfaces.

When the conventional wafer polishing apparatus is used to flatten such surface irregularities, the following problems arise: First, it is difficult to optimize the polishing performance. Second, is difficult to provide optimum polishing conditions for different products. Third, the form of the polishing apparatus is not well suited to present semiconductor fabrication environments, and hence there are obstacles to the smooth introduction of the wafer polishing apparatus. These problems will be described in detail below.

Surface irregularities (I) of devices which are produced in the device fabrication process are caused by patterning of interconnections or the like. The surface irregularities have intervals ranging from submicrons to millimeters, and heights of about 1 micron. In addition, surface irregularities (II) may result from ridges in the wafer surface due to irregular wafer film thicknesses before a device is fabricated, or the wafer itself may suffer warpage owing to stresses caused by heating or film growth steps while a device is being fabricated. These surface irregularities (I) and (II) may be simultaneously present at intervals of centimeters and heights of submicrons or more. Polishing must remove the former surface irregularities (I), without removing the latter surface irregularities (II). While the polishing pad has optimized thickness and resilience to flatten the surface irregularities in the conventional polishing apparatus, it is very difficult to make fine adjustment and achieve uniformity of the material of the polishing pad, resulting in a failure to obtain the required polishing performance.

The second problem, i.e., the difficulty of providing optimum polishing conditions for different products, makes it difficult to produce the application-specific integrated circuits (ASICs) that account for a large proportion of presently fabricated types of semiconductor integrated circuits. A high density of surface convexities are polished to a smaller degree than a low density of surface convexities. Different product types have different interconnection patterns, resulting in different densities of wafer surface irregularities. Since different product types therefore have different characteristics when under-going polishing, it is difficult to control the production of ASICs, which are a typical example of an article manufactured in many product types in small quantities.

The third problem, the difficulty of introducing polishing apparatus to present fabrication environments, involves limitations on installation sites for the wafer polishing apparatus. Since the slurry is a mixture of an aqueous solution of KOH and a fine powder of silicon oxide, the polishing apparatus itself is a source of dust particles and alkaline metal. The surface plate and neighboring parts may be enclosed within a sealing structure to prevent contamination of the area, but because the surface plate is large, the sealing structure will also be large in volume and difficult to keep clean. Opening of the sealing structure to service the wafer polishing apparatus results in contamination of the semiconductor fabrication site by dust particles and alkaline metal.

SUMMARY OF THE INVENTION

It is therefore an object of the present invention to provide a wafer polishing apparatus which provides improved wafer polishing performance, allows easy modification of polishing conditions during the process of fabricating semiconductor devices, and allows easy installation in a semiconductor fabrication site.

To achieve the above object, there is provided in accordance with the present invention a wafer polishing apparatus comprising an upwardly directed wafer chuck for holding a wafer to be polished upon a surface thereof, first drive means for rotating the wafer chuck, polishing solution supply means for supplying a polishing solution to the wafer held by the wafer chuck, a polishing head smaller in diameter than the wafer for holding a polishing pad which is smaller in diameter than the wafer, second drive means for rotating the polishing head, reciprocating means for reciprocally moving the polishing head, and pressing means for pressing the polishing pad against the wafer held by the wafer chuck by way of the polishing head.

The polishing pad may have a diameter substantially equal to the interval of undulations on the wafer.

A plurality of polishing heads may be provided for holding respective polishing pads of different types.

Since the polishing pad is relatively small in diameter, it readily follows a wafer surface which undulates at a small interval of about 1 cm. The wafer polishing apparatus can thus efficiently polish off surface irregularities caused by the interconnection pattern or the like without removing those surface irregularities which are produced by thickness irregularities or warpage of the wafer.

The relatively small polishing head design allows the wafer polishing apparatus to have a plurality of polishing heads to be used with one wafer chuck, with a different type of polishing cloth pad being attached to each polishing head. A desired polishing head may be selected for use depending on the pattern of surface irregularities to be polished off.

Because the surface of the wafer to be polished is directed upward, the slurry need only be supplied to the upper surface of the wafer. If the wafer chuck and neighboring components to which the slurry is applied are encased in a sealing structure, the sealing structure may be about 1/100 the size of the conventional sealing structure.

Inasmuch as the diameter of the polishing pad is substantially equal to the interval of undulations of the wafer, the polishing head is well-adapted to following the wafer surface.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
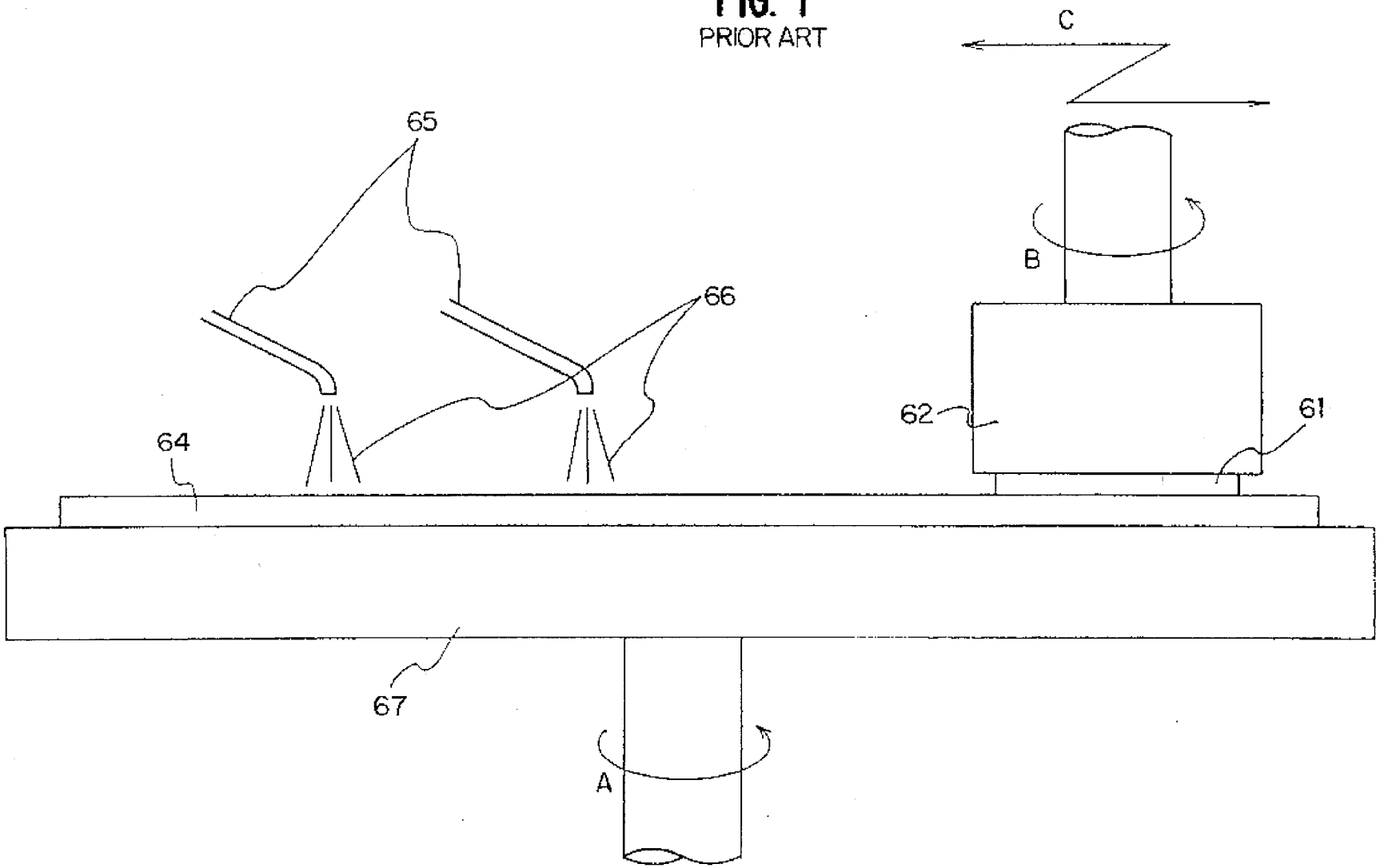
FIG. 1 PRIOR ART
FIG. 1 is a front elevational view of a conventional wafer polishing apparatus.
Figure 2:
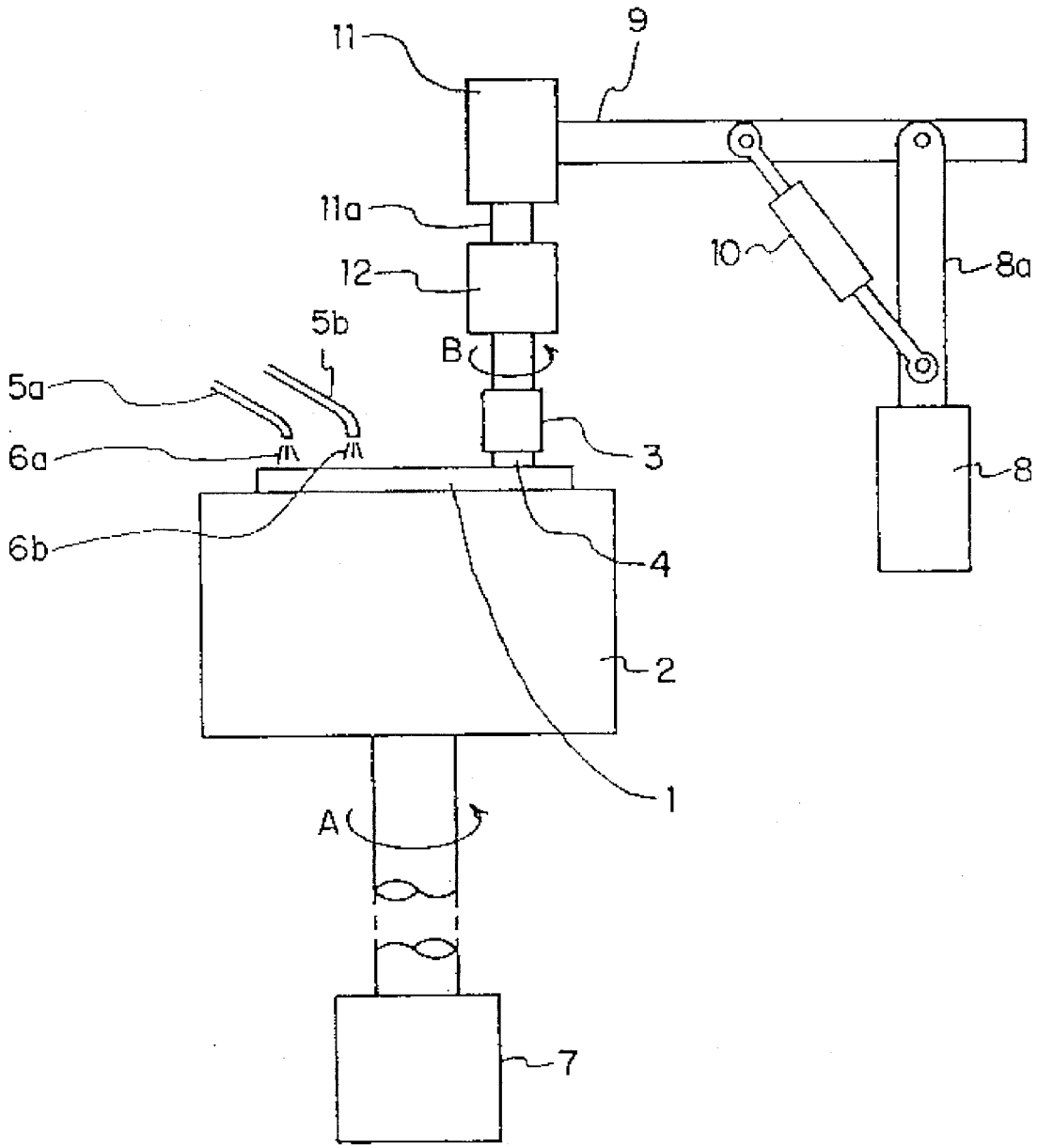
FIG. 2 is a front elevational view of a wafer polishing apparatus according to a first embodiment of the present invention.
Figure 3:
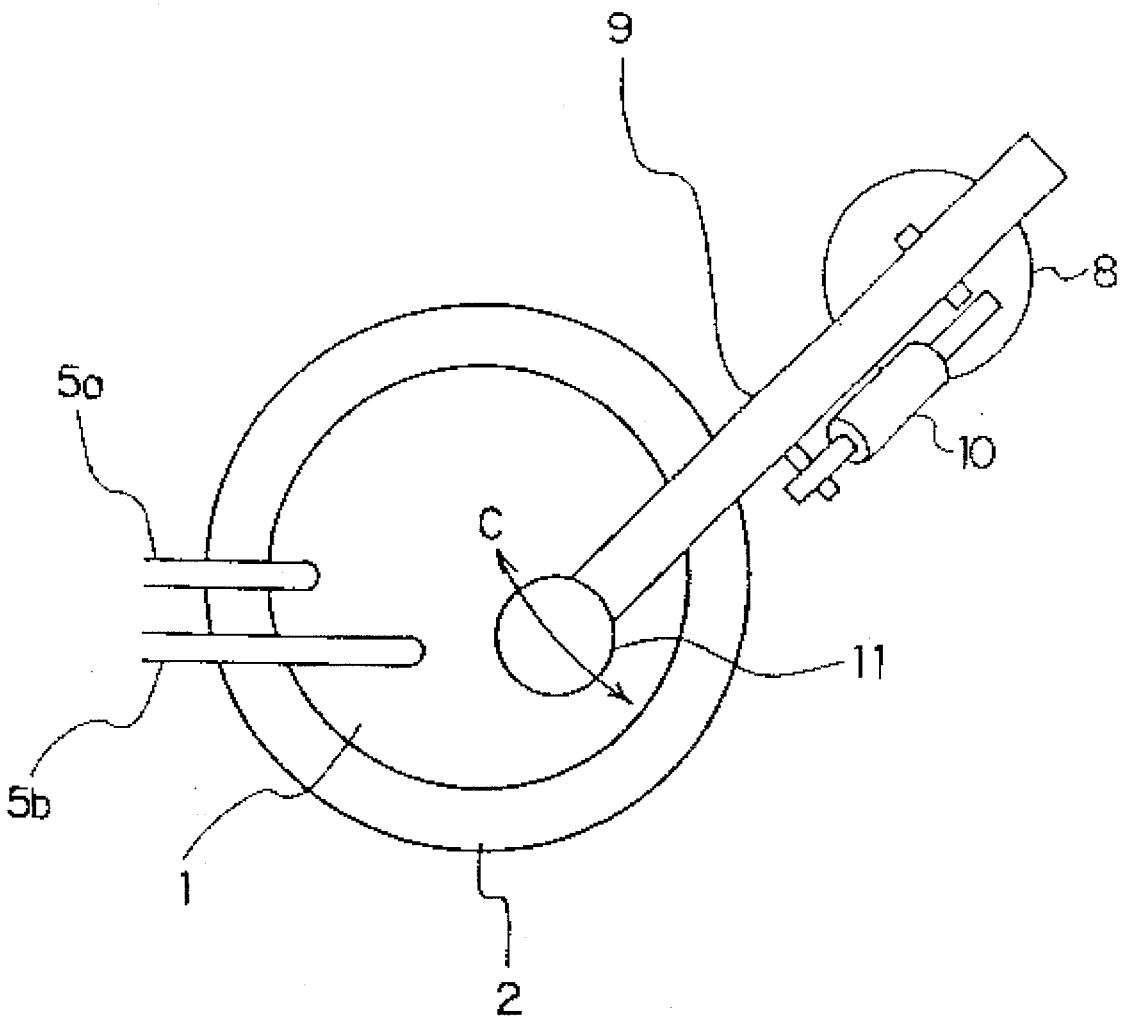
FIG. 3 is a plan view of the wafer polishing apparatus shown in FIG. 2.

1st Embodiment:

FIGS. 2 and 3 show a wafer polishing apparatus according to a first embodiment of the present invention. As shown in FIGS. 2 and 3, the wafer polishing apparatus according to the first embodiment comprises a wafer chuck 2 for holding a wafer 1 with the surface to be polished directed upward, the wafer chuck 2 being rotatable by a first drive means (to be described) in the direction indicated by arrow A; a pair of nozzles *5a*, *5b* provided as a polishing solution supply means for supplying respective slurries *6a*, *6b* as a polishing solution to the wafer 1; a polishing head 3 for holding a polishing cloth pad 4 smaller in diameter than the wafer 1, the polishing head 3 being rotatable by a second drive means (to be described) in the direction indicated by arrow B, which is the same direction as direction A, and being reciprocally movable by a reciprocating means (to be described) along the surface of the wafer 1 to be polished in the directions indicated by arrows C; and a polishing head load adjusting air cylinder 10 provided as a pressing means for pressing the polishing cloth pad 4 against the wafer 1 by way of the polishing head 3. The polishing head 3 is smaller in diameter than the wafer 1.

The wafer chuck 2 has substantially the same diameter as the wafer 1, and hence is much smaller than the conventional surface plate. The polishing head 3, which has a diameter of about 1 cm, is disposed to confront the wafer chuck 2, and the polishing cloth pad 4, which also has a diameter of about 1 cm, is attached to the polishing head 3. The stroke of reciprocal movement of the polishing head 3 is about the same as the radius of the wafer 1. The wafer 1 comprises a silicon substrate, for example. Since such a silicon substrate has surface undulations at an interval of about 1 cm, the polishing head 3 and the polishing cloth pad 4 are both of a diameter of about 1 cm, as described above.

The wafer chuck 2 is rotated in direction A by a wafer chuck rotation motor 7 provided as the first drive means. An arm driving motor 8 serving as the reciprocating means has a rotatable output shaft *8a* whose distal end is operatively coupled to one end of a polishing head reciprocating arm 9 which is angularly movable in a plane vertical to that of FIG. 2 as shown in FIG. 3. A polishing head rotation motor 11 provided as a second drive means is fixed to the other end of the polishing head reciprocating arm 9. The polishing head rotation motor 11 has a rotatable output shaft *11a* coupled through a resilient joint 12 to the polishing head 3, which can be rotated in direction B by the polishing head rotation motor 11. The arm driving motor 8 causes the polishing head reciprocating arm 9, and hence the polishing head rotation motor 11, to reciprocate in an arcuate path indicated by arrow C (see FIG. 3) about the output shaft *8a*. The polishing head load adjusting air cylinder 10 is provided as a pressing means and is connected between an intermediate portion of the polishing head reciprocating arm 9 and the output shaft *8a* of the arm driving motor 8. When the polishing head load adjusting air cylinder 10 is actuated to pull the polishing head reciprocating arm 9 downward, the polishing head 3 is pressed down toward the wafer chuck 2. The force with which the polishing head 3 is pressed down toward the wafer chuck 2 can be adjusted by varying the length of a projecting rod of the polishing head load adjusting air cylinder 10.

In operation, the wafer 1 with the surface to be polished directed upward is fixed to the wafer chuck 2, and the wafer chuck 2 is rotated at a speed of about 50 rpm. At the same time, the slurries *6a*, *6b* are supplied to the upper surface of the wafer 1 at a rate of about 10 ml/min. The polishing head 3 is rotated at a speed of about 1000 rpm, and the polishing cloth pad 4 is pressed against the upper surface of the wafer 1 under a pressure of about 500 g/cm$^2$. Simultaneously, the polishing head 3 is reciprocally moved across the upper surface of the wafer 1 to polish the wafer 1. The stroke of reciprocal movement of the polishing head 3 is about the same as the radius of the wafer 1.

Preferably, the wafer chuck 2 is rotated at a speed ranging from 10 to 1000 rpm, the polishing cloth pad 4 is rotated at a speed ranging from 10 to 2000 rpm, the polishing head 3 makes 10 to 100 reciprocating movements per minute, and the polishing head load adjusting air cylinder 10 exerts a pressure in the range of from about 10 to 500 g/cm$^2$. Inasmuch as the polishing head 3 is smaller than conventional polishing heads, it is preferable to increase the rotational speed of the polishing head 3 proportionally.

Figure 4:
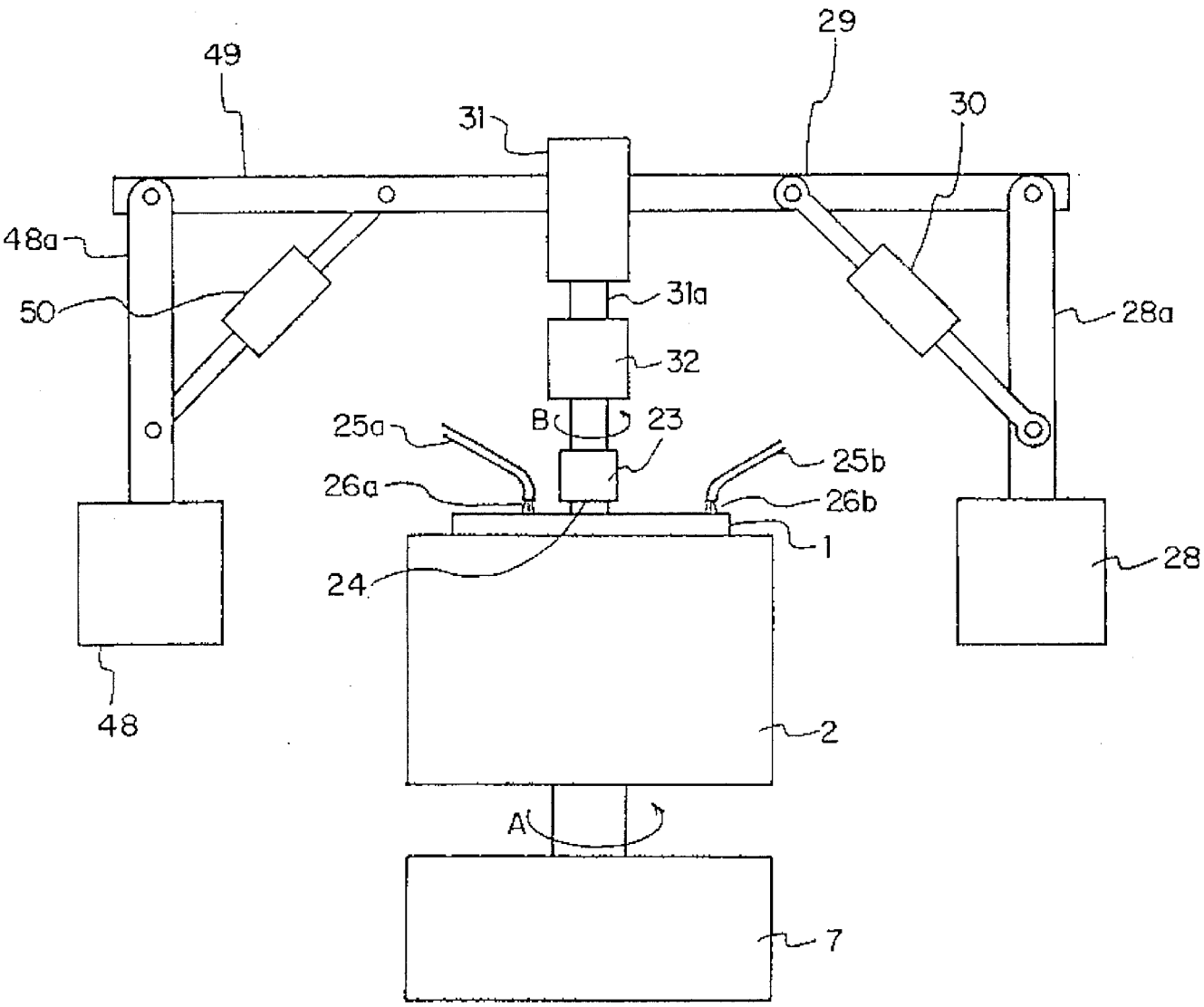
FIG. 4 is a front elevational view of a wafer polishing apparatus according to a second embodiment of the present invention.
Figure 5:
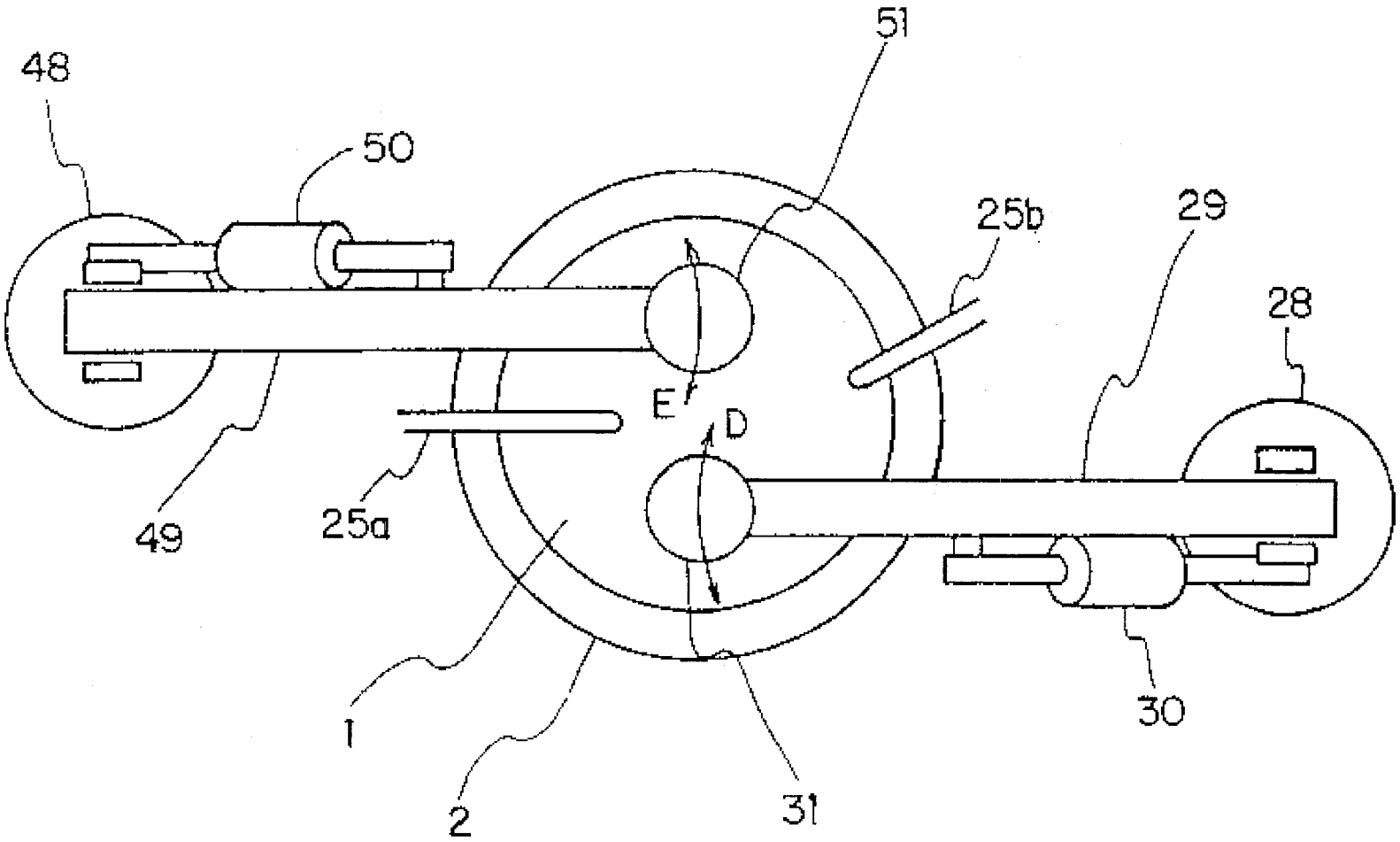
FIG. 5 is a plan view of the wafer polishing apparatus shown in FIG. 4.

2nd Embodiment:

FIGS. 4 and 5 show a wafer polishing apparatus according to a second embodiment of the present invention.

The wafer polishing apparatus according to the second embodiment has a plurality (in the illustrated embodiment, a pair) of polishing heads 23 with different types of polishing cloth pads 24 attached respectively thereto. A desired polishing head 23 is selected and used depending on the type of a wafer to be polished, i.e., depending on the pattern of surface irregularities on the wafer to be polished. Consequently, the wafer polishing apparatus according to the second embodiment allows easy selection of optimum polishing conditions suitable for the pattern of surface irregularities of a wafer to be polished. Each of the polishing heads 23 is associated with its own drive means and reciprocating means. Specifically, the polishing heads 23 are combined with respective arm driving motors 28, 48, respective polishing head reciprocating arms 29, 49, respective air cylinders 30, 50, and respective polishing head rotation motors 31, 51. The polishing heads 23 are positioned such that they will not physically interfere with each other and with nozzles 25*a*, 25*b* which supply respective slurries 26*a*, 26*b*. The other structural details of the wafer polishing apparatus according to the second embodiment are the same as those of the wafer polishing apparatus according to the first embodiment shown in FIGS. 2 and 3.

While the wafer polishing apparatus according to the second embodiment is shown as having two polishing heads, a wafer polishing apparatus may have three or more polishing heads and three or more sets of parts associated therewith.

In each of the above embodiments, the wafer is rotated in the same direction as the direction in which the polishing cloth pad is rotated. However, the wafer and the polishing cloth pad may be rotated in different directions. The polishing head or heads are shown as being reciprocally moved along an arcuate path about the output shaft or shafts of the arm driving motor or motors. However, the polishing head or heads may be reciprocally movable along a straight path.

Each of the wafer polishing apparatus according to the present invention offers the following advantages:

Since the polishing head is relatively small in diameter, the polishing head can follow the wafer surface which undulates at a small interval of about 1 cm. The wafer polishing apparatus can thus efficiently polish off surface irregularities caused by the interconnection pattern or the like without removing those surface irregularities which are produced by thickness irregularities or warpage of the wafer. Therefore, the wafer polishing apparatus provides optimized polishing performance.

The relatively small polishing head design allows the wafer polishing apparatus to have a plurality of polishing heads for one wafer chuck, with polishing cloth pads of different types being attached to the respective polishing heads. A desired polishing head is selected and used depending on the pattern of surface irregularities to be polished off. Accordingly, optimum polishing conditions can easily be selected depending on the type of surface irregularities to be removed. The pressing means and the wafer polishing apparatus can be reduced in size, with the result that the installation space and weight of the wafer polishing apparatus can also be reduced. The wafer polishing apparatus may easily be provided with a number of polishing units for increasing the number of wafers that can be polished per unit time.

Because the surface of the wafer to be polished is directed upward, the slurry need only be supplied to the upper surface of the wafer. The amount of slurry that must be supplied may thus be relatively small, thereby lowering the running cost of the wafer polishing apparatus. If the wafer chuck and neighboring components to which the slurry is applied are encased in a sealing structure, the sealing structure may be of a size which is about 1/100 of the size of the conventional sealing structure. Therefore, the interior of the sealing structure can easily be cleaned, and the scattering of any dust particles and alkaline metal when the sealing structure is opened is minimized, as is any contamination which is caused by scattered dust particles and alkaline metal. Such reduced contamination facilitates the introduction of the wafer polishing apparatus into a semiconductor fabrication site.

Inasmuch as the diameter of the polishing cloth pad is substantially equal to the interval of undulations of the wafer, the polishing head is well-suited to following the wafer surface.

Although certain preferred embodiments of the present invention have been shown and described in detail, it should be understood that various changes and modifications may be made therein without departing from the scope of the appended claims.

What is claimed is:

1. A wafer polishing apparatus comprising:

a wafer chuck for holding a wafer with a surface to be polished thereof being directed upward;

first drive means for rotating said wafer chuck;

polishing solution supply means for supplying a polishing solution to the wafer held by said wafer chuck;

a polishing head which is smaller in diameter than the wafer;

a polishing pad which is smaller in diameter than the wafer, said polished pad being attached to said polishing head;

second drive means for rotating said polishing head; reciprocating means for reciprocally moving said polishing head on said surface to be polished; and pressing means for pressing said polishing pad against a wafer held by said wafer chuck by way of said polishing head.

2. A wafer polishing apparatus according to claim 1 wherein said polishing pad has a diameter substantially equal to an interval of undulations of the wafer.

3. A wafer polishing apparatus according to claim 1 comprising a plurality of polishing heads for holding a corresponding plurality of polishing pads of different types.

4. A wafer polishing apparatus according to claim 2 comprising a plurality of polishing heads for holding a corresponding plurality of polishing pads of different types.

* * * * *